United States Patent [19]

Brown et al.

[11] 4,359,930

[45] Nov. 23, 1982

[54] VARIABLE SPEED CYLINDER ASSEMBLY PRESSURE SEALS

[75] Inventors: Robert M. Brown; John H. Short, both of Everett, Wash.

[73] Assignee: Western Gear Corporation, Everett, Wash.

[21] Appl. No.: 260,312

[22] Filed: May 4, 1981

Related U.S. Application Data

[63] Continuation of Ser. No. 69,266, Aug. 24, 1979, abandoned.

[51] Int. Cl.[3] ..... F01B 7/20

[52] U.S. Cl. ..... 91/53; 91/25; 92/52; 92/108

[58] Field of Search ..... 92/51, 52, 53, 107, 92/108, 164, 182, 117; 91/25, 167; 277/188 A

[56] References Cited

U.S. PATENT DOCUMENTS

| | | | |
|---|---|---|---|
| 1,548,182 | 8/1925 | Burgin | 92/52 X |
| 3,139,004 | 6/1964 | Haumann | 92/52 X |
| 3,171,334 | 3/1965 | Rasmussen | 277/188 A |
| 3,282,357 | 11/1966 | Bunn | 91/167 X |
| 3,565,446 | 2/1971 | Nyberg | 92/182 X |
| 4,075,929 | 2/1978 | Peterson | 92/51 X |

*Primary Examiner*—Gerald A. Michalsky
*Attorney, Agent, or Firm*—Seed, Berry, Vernon & Baynham

[57] ABSTRACT

A variable speed multi-cylinder assembly is provided with expandable bushing seals to block leakage of fluid from higher speed stages to lower speed stages.

6 Claims, 3 Drawing Figures

VARIABLE SPEED CYLINDER ASSEMBLY PRESSURE SEALS

This is a continuation of application Ser. No. 69,266, filed Aug. 24, 1979, now abandoned.

BACKGROUND OF THE INVENTION

1. Field of the Invention

This invention pertains to multi-stage multiple cylinder assemblies and more particularly to seals at the axially inner ends of said cylinders for preventing leakage of higher speed fluid to lower speed cylinders.

2. Description of the Prior Art

Typically, variable speed multiple cylinder assemblies are not machined along the entire length of a cylinder because sealing is required only when the next outer cylinder is fully retracted. That is, when a diametrically inner or higher speed stage is alone energized, the actuating fluid must be sealed from the cylinder of the next lower speed diametrically outer stage to get full utilization of the fluid pressure to the higher speed stage. Thus seals are provided only at the axially inner ends of the cylinders.

It is especially difficult to machine the full length of a cylinder in long cylinders such as used in hydraulic drilling rigs in which the cylinder length may be 40 feet long. A typical hydraulic drilling rig variable speed multi-cylinder assembly is shown in U.S. Pat. No. 3,282,357, the details of which are incorporated herein by reference thereto. The sealing as is shown in this patent is provided by an axially inner packing gland which is engaged by a machined extension of an inner ram for merely a short length of the inner ram. Sealing in this manner is unsatisfactory because the axially inner end of the ram and thus the machined sealing extension is not and cannot be accurately aligned relative to the packing gland such that tolerances must be provided between the packing gland and the machined extension to allow out of alignment conditions. The tolerances create leakage, allow wear and eventually require considerable maintenance or replacement of the packing which tends to extrude out because of the loose fit.

SUMMARY OF THE INVENTION

It is an object of this invention to provide a variable speed multi-stage cylinder having improved axially inner seals between the stages of the cylinder assembly.

It is another object of this invention to provide improved sealing apparatus between stages of a multi-stage selectively operable cylinder assembly.

Basically these objects are obtained in a preferred embodiment by providing the ram of a next diametrically outer stage with an inner sealing seat which confronts an opposed outer seat of a stationary portion of the cylinder assembly. Interposed between these seats is a continuous elongated cylindrical expandable sealing bushing with an O-ring seal on the pressurized inside face of the bushing. Preferably, the axially outer end of the bushing is tapered to provide guidance for the retracted next lower stage ram. In the alternative the sealing bushing can be carried on the rams either to mate with an outer seat on the stationary portion of the cylinder assembly or as in U.S. Pat. No. 3,282,357, the rams could have machined extensions which fit within the cylinder assembly with the cylindrical bushings fitted therebetween for expansion or for contraction into tight sealing engagement.

DETAILED DESCRIPTION OF THE PREFERRED EMBODIMENTS

Figures 1, 1A:
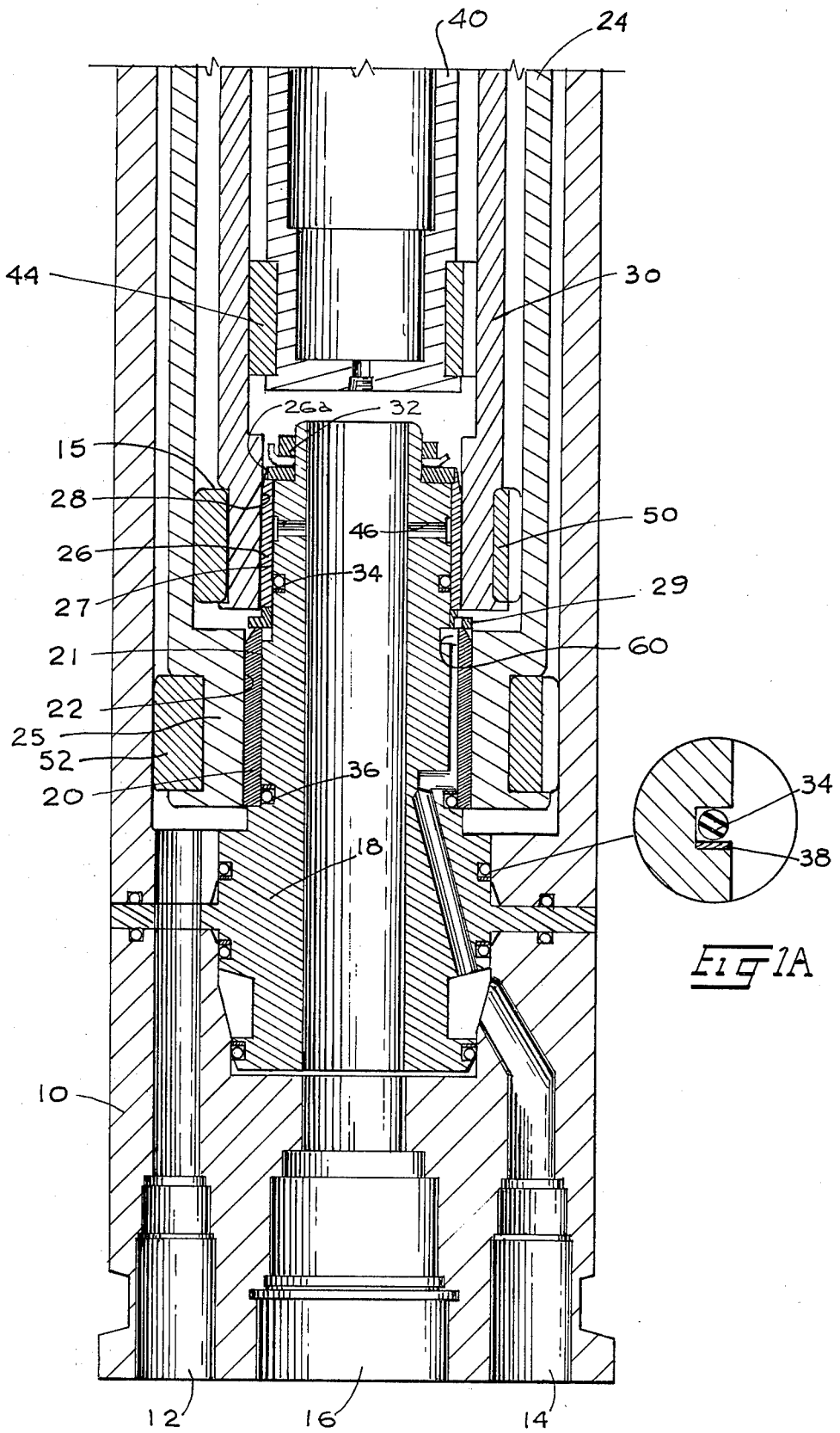
FIG. 1 is a longitudinal section of a preferred form of hydraulic cylinder assembly embodying the principles of the invention.
Figure 2:
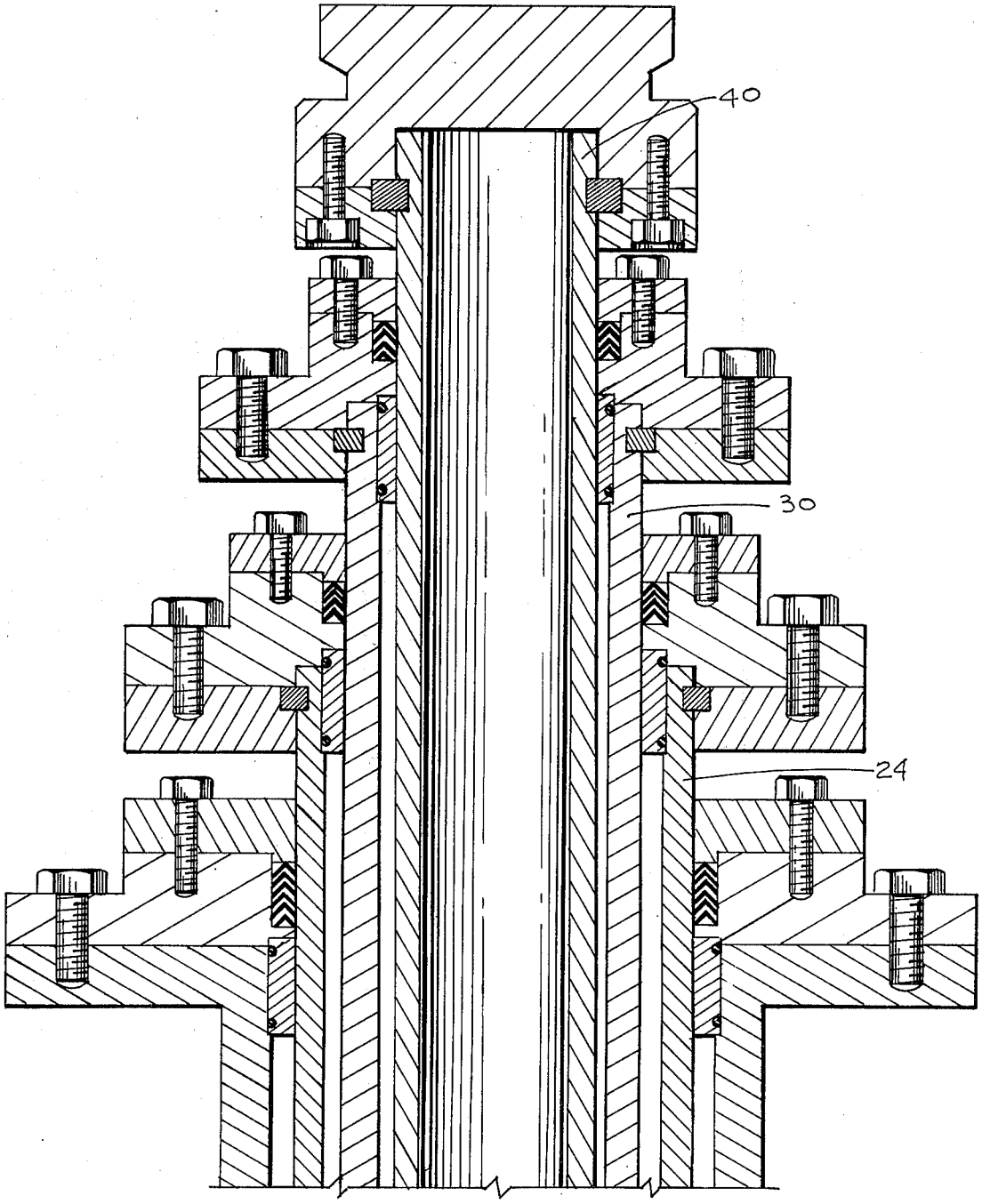
FIG. 2 is the upper end of the hydraulic cylinder assembly of FIG. 1.

As best shown in FIG. 1 the preferred form of hydraulic cylinder assembly includes a cylinder end 10 having a low speed hydraulic port 12, an intermediate speed port 14 and a high speed port 16. Fitted as a part of the cylinder end is an extension member or spud 18. As is well known, hydraulic fluid passes through the various ports to reach the top ends of the cylinder assembly selectively extending one or more of the rams of the head assembly. When the rams are retracted, the actuating hydraulic fluid must be sealed from leaking into the next lower stage cylinder in order to get effective actuation of the rams. For this purpose a continuous cylindrical bronze bushing 20 is seated between a sealing seat 21 on the extension 18 and a sealing seat 22 on a low speed ram 24. Similarly, a continuous cylindrical bronze bushing 26 is seated against a sealing seat 27 on the extension 18 and a sealing seat 28 on an intermediate speed ram 30.

Each of the cylindrical bushings has an axially outer end slightly tapered as at **26*a* (shown slightly exaggerated for clarity) to assist in guiding the inner end of the intermediate and low speed rams into the fully retracted position. The bushings are held in place on the extension 18 by a lock washer and nut 32**.

The bushings 26 and 20 are separated by a ported spacer ring 29 which allows hydraulic fluid to pass from port 14 into the upper end of the intermediate speed cylinder defined by low speed ram 24.

The high speed ram 40, the intermediate speed ram 30 and the low speed ram 24 have respectively axially inner ported guide bushings 44, 50 and 52. The guide bushings hold the lower ends of the rams generally centered in the next outermost cylinder.

In order to further restrict passage of hydraulic fluid from the inside faces of the bushings 20 and 26, the extension 18 is provided with O-ring seals 34 and 36 each of which is provided with an anti-extrusion plate 38 as shown in FIG. 1A.

In operation pressure admitted to the high speed port 16 alone will pressurize the high speed ram 40. The high speed hydraulic fluid will pass through diametrical slots 46 against the radially inside surface of the bushing 26. The bushing 26 will expand, pressing tightly against the seat 28 while the O-ring seal 34 seals the inside face of the bushing. Thus, the actuating hydraulic fluid is unable to leak into the intermediate speed cylinder area. For intermediate speed operation hydraulic fluid is admitted simultaneously to high speed port 16 and intermediate speed port 14. The oil from intermediate speed port 14 passes axially upward along the inside face of the bushing 20 through a groove 60 and thence to the upper end of the cylinder defined by low speed ram 24. The hydraulic fluid expands the sealing bushing 20 with the O-ring seal 36 preventing leakage into the low speed cylinder area. For low speed operation all three ports are energized, as is well known.

While the preferred embodiments of the invention have been illustrated and described, it should be understood that variations will be apparent to one skilled in the art without departing from the principles herein. Accordingly, the invention is not to be limited to the specific embodiment illustrated in the drawings.

We claim:

1. A selectively actuatable cylinder assembly of the type having an axially extendible inner first ram and at least one outer, hollow, axially extendible second ram having an inside cylindrical surface forming an inner cylinder for the inner ram, an outer cylinder, and axially outer means sealing the rams and cylinders, the improvement comprising axially inner sealing means sealing the inner cylinder from the outer cylinder, said axially inner sealing means including a first seat in fluid communication with actuating fluid for said inner first ram, said outer ram having a second seat in fluid communication with actuating fluid for said outer second ram, and a generally cylindrical, radially expandable sealing bushing interposed between said seats and spaced closely enough to said second seat sufficient to provide a pressure drop along the bushing and opposed second seat when the bushing is in a relaxed condition, said bushing being expandible by the fluid pressure differential of said actuating fluid for said inner ram acting between the bushing and the first seat and between the bushing and the second seat at substantially any magnitude as the fluid passes between said bushing and said second seat, and third sealing means for sealing between the first seat and the opposed face of said bushing for blocking said inner ram actuating fluid from passing axially out past said bushing and first seat into the outer cylinder, said second seat and bushing being moved axially completely past one another when said second ram and bushing are moved axially relative to one another.

2. The assembly of claim 1, said third sealing means including an O-ring seal and an anti-extension ring adjacent said O-ring seal on the side thereof between the O-ring seal and the outer cylinder.

3. The assembly of claim 1, said bushing having an axially and diametrically outer tapered surface for guiding the ram second seat into alignment against the bushing when said second ram is retracted.

4. The assembly of claim 1, said outer cylinder being a first outer cylinder and including a hollow third ram having an inner cylindrical surface forming said outer first cylinder and being the cylinder for said second ram, a second outer cylinder, said first, second and third rams being actuatable, respectively, as high, intermediate and low speed rams, including axially inner and axially outer sealing means between said second and third rams, said axially inner sealing means between said second and third rams including a third seat in fluid communication with actuating fluid for said second ram, said third ram having a fourth seat in fluid communication with actuating fluid for said third ram, and a generally cylindrical, elongated, radially expandable sealing second bushing interposed between said third and fourth seats, said bushing being expandable by the fluid pressure of said actuating fluid for said second ram, and fourth sealing means sealing between said third seat and opposed face of the second bushing for blocking said second ram actuating fluid from passing axially out past said second bushing into said second outer cylinder.

5. The assembly of claim 4, each of said bushings having an axially and diametrically outer tapered surface for guiding the sealing of the respective ram into alignment therewith.

6. A selectively operable, multiple ram cylinder assembly having a cylinder base and including at least one extendible radially inner ram and an extendible radially outer ram, said outer ram being hollow and providing a first cylinder for said inner ram, and having a radially outer second cylinder encircling said outer ram, said rams and cylinders having axially outer sealing means and axially inner sealing means therebetween, the improvement comprising:

said axially inner sealing means including opposed radially inner and outer sealing seats on the cylinder base and the axially inner end of the radially outer ram, respectively, and elongated, continuous, cylindrical, deformable sleeve means positioned between said seats, said outer sealing seat on said axially inner end of the radially outer ram and said deformable sleeve means being spaced closely enough when said sleeve means is in a relaxed, non-expanded condition to create a pressure drop therebetween at substantially any magnitude of pressure of actuating fluid, there being no additional seals along said bushing and said outer sealing seat to interfere with movement of said outer sealing seat, means for directing actuating fluid to said radially inner ram, said radially outer sealing seat and said sleeve means being moved axially completely past one another when said outer ram and cylindrical base are extended relative to one another;

means for exposing both sides of said sleeve means to the inner ram but with fluid initially leaking between the radially outer sealing seat and the bushing to create a presssure differential across the sleeve means, causing actuating fluid to expand the sleeve means into sealing contact with the opposite radially outer sealing seat for restricting the inner ram fluid from leaking into the outer cylinder; and supplementary sealing means between said inner sealing seat and the side of the sleeve means exposed to the inner ram actuating fluid for blocking leakage of the inner ram actuating fluid between the inner sealing seat and the sleeve means into the radially outer cylinder.

* * * * *